US010415767B1

(12) United States Patent
Felizzola

(10) Patent No.: US 10,415,767 B1
(45) Date of Patent: Sep. 17, 2019

(54) LIGHTING APPARATUS

(71) Applicant: Humberto E. Felizzola, Carney, MD (US)

(72) Inventor: Humberto E. Felizzola, Carney, MD (US)

( * ) Notice: Subject to any disclaimer, the term of this patent is extended or adjusted under 35 U.S.C. 154(b) by 0 days.

(21) Appl. No.: 16/023,842

(22) Filed: Jun. 29, 2018

(51) Int. Cl.
*F21K 9/275* (2016.01)
*F21V 23/00* (2015.01)

(52) U.S. Cl.
CPC ..... *F21K 9/275* (2016.08); *F21V 23/002* (2013.01)

(58) Field of Classification Search
CPC ..... F21S 2/005; F21S 4/20; F21S 4/22; F21S 4/24; F21S 4/26; F21S 4/28; F21V 19/0015; F21V 19/0055; F21V 19/004; F21V 21/08; F21V 21/0808; F21V 23/002; F21V 23/06
See application file for complete search history.

(56) References Cited

U.S. PATENT DOCUMENTS

| | | | | |
|---|---|---|---|---|
| 6,682,205 | B2 * | 1/2004 | Lin | F21S 4/26 362/222 |
| 7,064,674 | B2 | 6/2006 | Pederson | |
| 7,296,912 | B2 * | 11/2007 | Beauchamp | A47F 3/001 362/227 |
| 9,243,759 | B2 | 1/2016 | Lin et al. | |
| 9,267,650 | B2 * | 2/2016 | Simon | F21K 9/27 |
| 9,510,400 | B2 * | 11/2016 | Scapa | H05B 33/08 |
| 2003/0063463 | A1 * | 4/2003 | Sloan | F21V 21/0808 362/238 |
| 2007/0064428 | A1 * | 3/2007 | Beauchamp | A47F 3/001 362/294 |
| 2009/0073692 | A1 * | 3/2009 | Berger | A47B 97/00 362/249.02 |

* cited by examiner

*Primary Examiner* — Tsion Tumebo
(74) *Attorney, Agent, or Firm* — Sanchelima & Associates, P.A.; Christian Sanchelima; Jesus Sanchelima

(57) ABSTRACT

A lighting apparatus that can be retro fitted is disclosed. The lighting apparatus comprises a housing and a plurality of illuminating units. Each of the illuminating units comprises a connector used to couple the illuminating unit to the housing. The plurality of illuminating units is coupled to the housing at equal distance and in series.

7 Claims, 3 Drawing Sheets

LIGHTING APPARATUS

BACKGROUND OF THE INVENTION

1. Field of the Invention

The present disclosure generally relates to a lighting apparatus. More specifically, the present disclosure generally relates to a lighting apparatus comprising Light Emitting Diode (LED) lights provided in a series and spaced at equal distance.

2. Description of the Related Art

It is known that neon lamps, fluorescent lamps, and incandescent lamps have been used in residences, offices, industrial, and a host of other environments, for providing light. However, each of the neon lamps, the fluorescent lamps, and the incandescent lamps has several drawbacks. For instance, the neon and fluorescent lamps include difficulty in starting in cold temperatures, dangerous high-voltage operation, and the presence of mercury that in turn creates an environmental hazard. The incandescent lamps generate a large amount of heat, have poor resistance to vibration, have short lamp life, and consume large amounts of energy with the result that most of their light energy is wasted as infrared heat energy.

In order to overcome the drawbacks of the neon lamps, the fluorescent lamps, and the incandescent lamps, Light Emitting Diode (LED) lights have been used in recent time. When compared to the neon lamps, the fluorescent lamps, and the incandescent lamps, the LED lights are much more efficient at converting electrical energy into light, are longer lasting, and are also capable of producing light that is very natural.

Several attempts have been made in the past to incorporate LED lights in place of the fluorescent lamps, in order to overcome some of the drawbacks of fluorescent lighting apparatus and/or to obtain certain other benefits. Some of these attempts have involved retrofitting existing fluorescent lighting fixtures to utilize LEDs or providing a means to have replaceable LED modules. An example of having a LED-based lighting unit for retrofitting a fluorescent light fixture is disclosed in a U.S. Pat. No. 9,243,759. In U.S. Pat. No. 9,243,759, the LED lighting unit is provided in a concave structure for fitting snugly into the cavity used for a fluorescent lighting fixture using connector pins on either end of the structure for securing the housing within the cavity. The LED lighting unit comprises a plurality of LED modules connected in daisy chain fashion along the length of the LEI) lighting unit.

Another example illustrating a means to have replaceable LEI) modules is disclosed in a U.S. Pat. No. 7,064,674. In U.S. Pat. No. 7,064,674, a plurality of ports provided on a lighting support is disclosed. Each of the ports is coupled to a module support member that receives a module comprising LEDs. The modules are removably mounted on the module support member.

It should be noted that the above disclosures have several problems. For instance, the LED lighting unit comprises ports that are fixed to a support member receives LEDs. Due to its fixed structure, it has limited usability. For example, if one LED goes off, then all the LEDs have to be switched OFF in order to replace the faulty LED. In addition, the LEDs are fitted snugly into the cavity provided at the lighting support. At the time of replacing LEDs, if the snug fit breaks, then it is not possible to attach the LEDs to the lighting support resulting in poor lighting.

Other documents describing the closest subject matter provide for a number of more or less complicated features that fail to solve the problem in an efficient and economical way. None of these patents suggest the novel features of the present invention. Specifically, none of the disclosures in the art disclose a firearm that is operated manually by depressing the bolt catch to load each subsequent cartridge into the chamber.

Therefore, there is a need in the art for a lighting apparatus that can be retrofitted into an existing lighting apparatus.

SUMMARY OF THE INVENTION

It is one of the main objects of the present invention to provide a lighting apparatus comprising a plurality of illuminating units provided in a series and spaced equally that avoids the drawbacks of the prior art.

It is one object of the present invention is to provide a lighting apparatus that has fewer components and facilitates in retrofitting LEDs to a housing.

It is one object of the present invention is to provide a lighting apparatus comprising a connector used to couple a plurality of illuminating units to a housing.

It is one object of the present invention is to provide a lighting apparatus comprising a housing and a plurality of illuminating units. Each of the illuminating units comprises a connector used to couple the illuminating unit to the housing. The plurality of illuminating units is coupled to the housing at equal distance and in series.

It is one object of the present invention is to provide a lighting apparatus comprising a plurality of housings provided in series. The lighting apparatus comprises a plurality of illuminating units provided at each of the plurality of housings. Each illuminating unit comprises a connector used to couple the illuminating unit to the housing. The plurality of illuminating units is coupled to the housing at equal distance and in series.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a lighting apparatus comprising a housing and a plurality of illuminating units. Each of the illuminating units comprises a connector used to couple the illuminating unit to the housing. The plurality of illuminating units is coupled to the housing at equal distance and in series. The lighting apparatus comprising a plurality of housings coupled in series is also disclosed.

Various features and embodiments of a lighting apparatus that can be retro fitted are explained in conjunction with the description of FIGS. 1A-3.

Figure 1A:
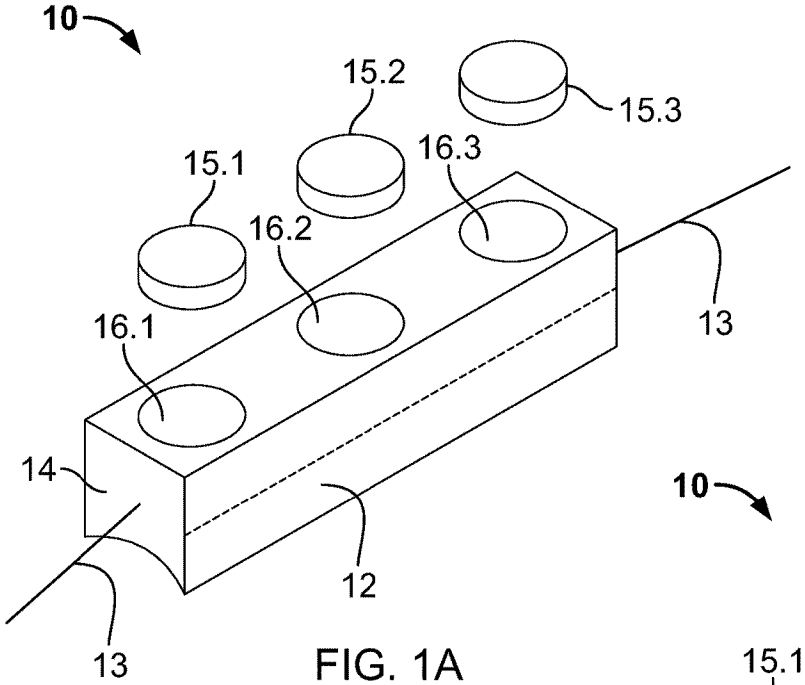
FIGS. 1A and 1B illustrate an exploded view and a perspective view of a lighting apparatus 10, respectively, in accordance with one embodiment of the present disclosure.

Referring to FIG. 1A, an exploded view of a lighting apparatus 10 is shown, in accordance with one embodiment of the present disclosure. The lighting apparatus 10 comprises a housing 12. The housing 12 is made up of plastic, wood or any other suitable material. It should be understood that the material of the housing 12 selected is an insulator, which does not allow current to pass through. The housing 12 may be provided in a square, rectangular, tubular or cylindrical space. As can be seen, the housing 12 comprises ends 13. The ends 13 may be provided in a flat or contoured shape.

The lighting apparatus 10 comprises a wire 14 coupled to the housing 12 at one or both ends of the housing 12. It should be understood that the wire 14 is drawn through the housing 12 or may be provided external to the housing 12. The lighting apparatus 10 comprises a plurality of illuminating units 15.1, 15.2, 15.3 and so on. The illuminating units 15.1, 15.2, 15.3 may include but not limited to Light Emitting Diodes (LED) lights. The plurality of illuminating units 15.1, 15.2, 15.3 are collectively termed as illuminating units 15 for ease of reference. In accordance with preferred embodiment of the present embodiment, each of the illuminating unit 15 comprises a connector 16 at the bottom. As such, each of the illuminating units 15.1, 15.2, and 15.3 comprises the connectors 16.1, 16.2, 16.3, respectively. The connectors 16.1, 16.2, 16.3 are collectively termed as the connector 16 for ease of reference.

In one example, the connector 16 may include, but not limited to, an adhesive strip. It should be understood both top and bottom surfaces of the connector 16 may be coated with an adhesion material. It order to couple the connector 16 to the illuminating unit 15, top portion of the connector 16 is brought in axis to that of the illuminating unit 15. Subsequently, pressure is applied to attach the connector 16 to the illuminating unit 15. Upon coupling the connector 16 to the illuminating unit 15, the connector 16 i.e., the bottom is coupled to the housing 12.

Although it is presented that the connector 16 is used to couple the illuminating unit 15 to the housing 12, it should be understood that other known mechanisms to couple two components might also be employed to couple the illuminating unit 15 to the housing 12. For example, the connector 16 is used a snap-lock connector in which the connector 16 comprises a hook and the housing 12 comprises at least one locking member such as a hole (not shown). In accordance with the above example, one end of the connector 16 comprising adhesion material is coupled to the illuminating unit 15. Other end comprising the hook is coupled to the housing 12 at the hole to lock the illuminating unit 15 to the housing 12. It should be understood that a plurality of holes are provided at the housing 12 spaced at equal distance to receive the illuminating unit 15 i.e., the connector 16 with the hook. In order to release the illuminating unit 15 from the hole provided at the housing 12, the illuminating unit 15 may be pulled to release the hook from the hole.

Figure 1B:
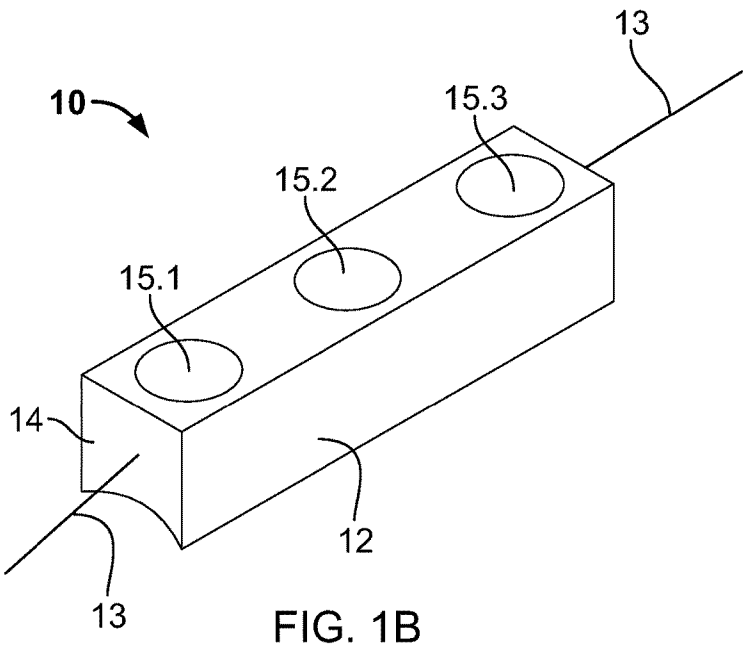

Referring to FIG. 1B, a perspective view of the lighting apparatus 10 in which the illuminating unit 15 is coupled to the housing 12 is shown, in accordance with one embodiment of the present disclosure. In one example, the connector 16 is made up of conductive material. As such, when the connector 16 (one end connected to the housing 12 and other end coupled to the illuminating unit 15) is coupled to the housing 12, the illuminative unit 15 comes in contact electrically with the wire 14 and illuminates. As presented above, the plurality of illuminating units 15.1, 15.2, 15.3 are provided in a series and spaced at equal distance. As a result, when the illuminating units 15.1, 15.2, 15.3 are coupled to a power source (not shown) through the wire 14, light produced by the plurality of illuminating units 15.1, 15.2, 15.3 is distributed evenly in the area in which the lighting apparatus 10 is deployed.

Figure 2:
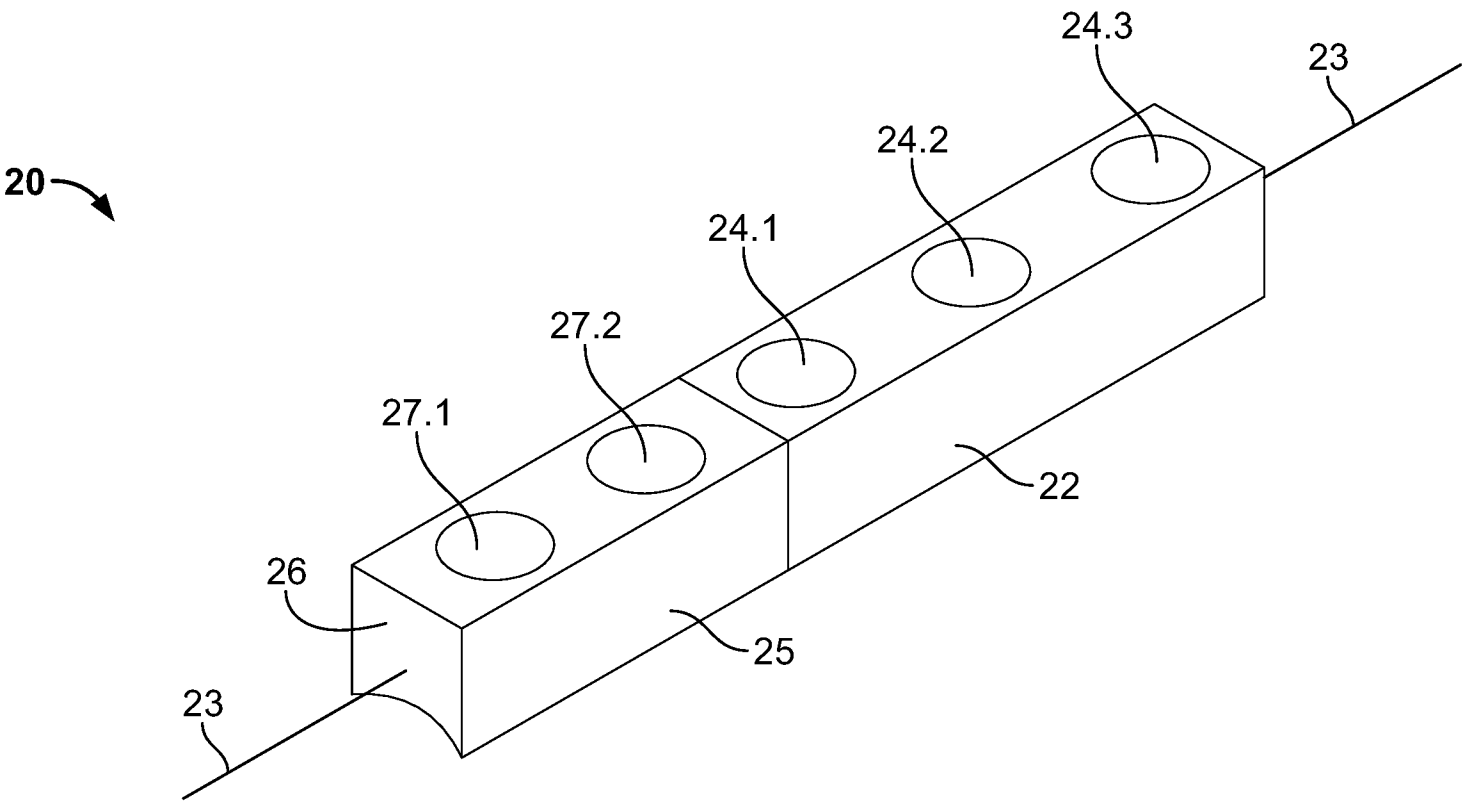
FIG. 2 illustrates a perspective view of a lighting apparatus 20 comprising a plurality of housings 22 and 25 provided in series, in accordance with one embodiment of the present disclosure.

Referring to FIG. 2, a perspective view of a lighting apparatus 20 comprising a first housing 22 and a second housing 25 is shown. The first housing 22 comprises a wire 23 drawn through the first housing 22 and made to come out at one or both ends (not shown). Further, the first housing 22 comprises a plurality of first illuminating units 24.1, 24.2, 24.3 and so on. Each of the plurality of first illuminating units 24.1, 24.2, 24.3 is coupled to the first housing 22 using a plurality of connectors (not shown) respectively. The connectors are used to couple the illuminating units 24.1, 24.2, 24.3 to the first housing 22. As presented above, the connectors may include, but not limited to, adhesive strips. The plurality of first illuminating units 24.1, 24.2, 24.3 is coupled to the first housing 22 in a series and spaced at equal distance.

As specified above, the lighting apparatus 20 comprises a second housing 25. The second housing 25 comprises the wire 23 extended from the first housing 22. Further, the second housing 22 comprises ends 26. The ends 26 may be provided in a flat or contoured shape. The second housing 25 comprises a plurality of second illuminating units 27.1, 27.2 and so on. Each of the plurality of second illuminating units 27.1, 27.2 is coupled to the second housing 25 using a plurality of connectors (not shown) respectively. The connectors are used to couple the illuminating units 27.1, 27.2 to the second housing 25. The plurality of second illuminating units 27.1, 27.2 is coupled to the second housing 25 in a series and spaced at equal distance.

It should be understood that the first housing 22 and the second housing 25 are coupled in series as shown in FIG. 2. Further, the wire 23 is connected to a power source (not shown). When powered, the wire 23 draws power from the power source and the plurality of first illuminating units 24.1, 24.2, 24.3 and the plurality of second illuminating units 27.1, 27.2 are illuminated. The current embodiment is presented to illustrate that the lighting apparatus 20 may comprise two or more housings (22 and 25) coupled in series and each of the housings may comprise two or more illuminative units removably coupled and spaced at equal distance, respectively.

Figure 3:
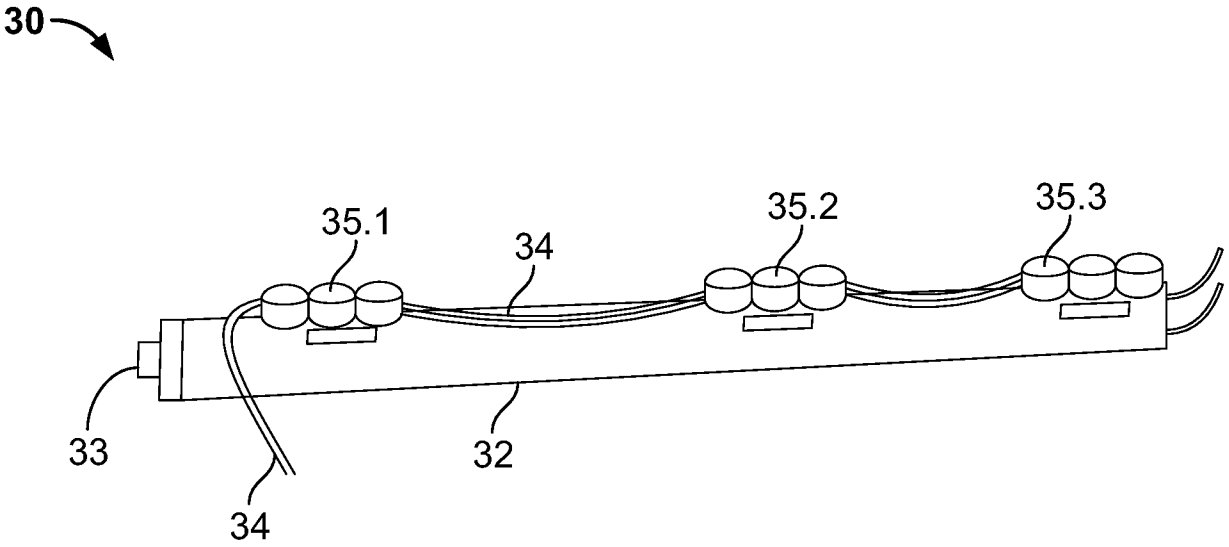
FIG. 3 illustrates a perspective view of a lighting apparatus 30 comprising a group of plurality of illuminating units 35 provided in series, in accordance with one embodiment of the present disclosure.

Now, referring to FIG. 3, a lighting apparatus 30 is shown, in accordance with one embodiment of the present disclosure. The lighting apparatus 30 comprises a housing 32. The housing 32 may indicate a fluorescent fixture that is known in the art. The housing 32 comprises a support structure 33 that allows coupling the lighting apparatus 30 to a wall or to other objects. The lighting apparatus 30 further comprises a wire 34 coupled to a power source (not shown) at one end and coupled to a group of plurality of illuminating units

35.1, 35.2, 35.3 (referred as 35). Each group of the plurality of illuminating units 35 may comprise two or more illuminating units. For instance, a first group of plurality of illuminating units 35.1 may comprise two illuminating units. Further, a second group of plurality of illuminating units 35.2 may comprise three illuminating units. Furthermore, a third group of plurality of illuminating units 35.3 may comprise three illuminating units. As such, the lighting apparatus 30 may be provided two or more group of illuminating units, where each group comprises two or more illuminating units.

It should be understood that each group of plurality of illuminating units are spaced at equal distance to ensure that light is distributed evenly where the lighting apparatus 30 is deployed.

Although the above description is provided to include two or more illuminating units provided at equal distance, it should be obvious that the two or more illuminating units may be provided at varied distance from one another. Further, the two or more illuminating units may be placed in other fashions i.e., other than in series. For instance, the two or more illuminating units may be placed at equal distance in a zigzag or daisy chain fashion.

The lighting apparatus may be used as a portable device to carry from one place to another. As specified above, each of the illuminating unit is coupled to the housing using a connector. As such, whenever one illuminating unit goes OFF, the illuminating unit may be removed from the housing and another illuminating unit may be replaced in quick time. Further, the lighting apparatus can be used to retrofit the illuminating units to an existing fluorescent lamp/fixture. Further, the lighting apparatus may be provided with two or more illuminating units having varied sizes that can be interchanged based on usage. In other words, the lighting apparatus can be customized based on the need i.e., number of illuminating units, size of the illuminating units and number of the housings required may be changed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lighting apparatus, comprising a housing; and a plurality of illuminating units, each comprising a connector, wherein said connector comprises a hook, wherein said housing comprises at least one locking member adapted to receive said hook to couple said plurality of illuminating units to said housing, wherein said plurality of illuminating units are coupled to said housing an equal distance apart and in series.

2. The lighting apparatus of claim 1, wherein the plurality of illuminating units is Light Emitting Diodes (LED).

3. The lighting apparatus of claim 1, wherein the housing comprises a wire drawn through.

4. The lighting apparatus of claim 3, wherein the wire is coupled to a power source.

5. The lighting apparatus of claim 1, wherein the connector is an adhesive strip.

6. The lighting apparatus of claim 1, wherein the connector is removably attached to the housing.

7. The lighting apparatus of claim 1, wherein the plurality of illuminating units provided in series is aligned in a linear axis of the housing.

* * * * *